US008696838B1

(12) United States Patent
Faridi et al.

(10) Patent No.: US 8,696,838 B1
(45) Date of Patent: Apr. 15, 2014

(54) FOAMED CELLULOID PROCESS USING EXPANDABLE BEADS

(75) Inventors: Niloufar Faridi, Melville, NY (US); Linjie Zhu, Livingston, NJ (US); Ming-Wan Young, Basking Ridge, NJ (US); Costas G. Gogos, Wyckoff, NJ (US); Fei Shen, North Arlington, NJ (US); Elbert Caravaca, Budd Lake, NJ (US); Mohamed Elalem, East Orange, NJ (US); Viral Panchal, Parlin, NJ (US); Dale Conti, Flanders, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 13/307,653

(22) Filed: Nov. 30, 2011

Related U.S. Application Data

(63) Continuation-in-part of application No. 12/977,374, filed on Dec. 23, 2010, now Pat. No. 8,597,444, which is a continuation-in-part of application No. 12/483,420, filed on Jun. 12, 2009.

(60) Provisional application No. 61/061,249, filed on Jun. 13, 2008.

(51) Int. Cl.

| | |
|---|---|
| ***C06B 45/00*** | (2006.01) |
| ***C06B 45/04*** | (2006.01) |
| ***C06B 45/10*** | (2006.01) |
| ***D03D 23/00*** | (2006.01) |
| ***D03D 43/00*** | (2006.01) |

(52) U.S. Cl.
USPC ..... 149/109.6; 149/2; 149/17; 149/19.8; 149/109.2; 149/109.4

(58) Field of Classification Search
USPC ..... 149/19.8, 2, 17, 109.2, 109.4, 109.6
See application file for complete search history.

(56) References Cited

U.S. PATENT DOCUMENTS

| | | | | |
|---|---|---|---|---|
| 2011/0240904 | A1* | 10/2011 | Chiou et al. | 252/62 |
| 2012/0260814 | A1* | 10/2012 | Worrell et al. | 102/431 |
| 2012/0318123 | A1* | 12/2012 | Worrell et al. | 86/10 |

* cited by examiner

*Primary Examiner* — James McDonough
(74) *Attorney, Agent, or Firm* — Henry S. Goldfine

(57) ABSTRACT

A method of manufacture of foamed celluloid molded products, involving three steps for the manufacture of higher density (0.7 to 1.25 gm/cc) foamed celluloid products or simple geometry lower density (0.2 to 0.7 gm/cc) foamed celluloid products, and four steps for the manufacture of lower density foamed celluloid products of any geometry. The three step process involving: (1) providing small, uniform, pieces of celluloid; (2) presoaking the pieces in a physical blowing agent (PBA) under pressure; and (3) foaming at raised temperature a controlled quantity of the presoaked pieces in a mold—to obtain the desired shape and density. For a lower density foamed celluloid product, of any moldable geometry, the steps are to: (1) small pieces of celluloid, that (2) have been presoaked in a PBA, are (3) pre-expanded to an intermediate density, and then (4) foam the desired lower density foamed product in a mold at raised temperature.

16 Claims, No Drawings

FOAMED CELLULOID PROCESS USING EXPANDABLE BEADS

CROSS-REFERENCE TO RELATED APPLICATIONS

This application is a continuation-in-part of currently U.S. patent application Ser. No. 12/977,374, filed Dec. 23, 2010 now U.S. Pat. No. 8,597,444; which itself was a continuation-in-part of a currently co-pending parent U.S. patent application Ser. No. 12/483,420, filed Jun. 12, 2009; which parent application claimed the benefit under 35 USC §119(e) of U.S. provisional Patent Application No. 61/061,249, filed on Jun. 13, 2008. All of which prior U.S. patent applications, i.e. Ser. Nos. 12/977,374, 12/483,420 and Provisional Application No. 61/061,249, are hereby incorporated by reference, as if each was set-out herein in its totality.

FEDERAL RESEARCH STATEMENT

The invention described herein may be manufactured, used, and/or licensed by the U.S. Government for U.S. Government purposes.

FIELD OF THE INVENTION

The present invention relates to a method of manufacture of foamed celluloid products, specifically, a method can be easily scaled for the economical, mass production of such products.

BACKGROUND OF THE INVENTION

Celluloid is regarded as the first thermoplastic material, a material created by Alexander Parkes in 1862, by mixing cellulose nitrate with camphor to produce a hard, flexible material which he trade named Parkesine. Today, celluloid is generally considered to be a class of materials created from nitrocellulose and camphor, which is highly flammable. Typically, celluloid is composed of 70 to 80 parts nitrocellulose, nitrated to 11% nitrogen, and about 30 parts camphor, which acts as a plasticizer for the nitrocellulose, plus small parts dyes, stabilizers and other ingredients to increase stability and reduce flammability.

Commercial manufacture of celluloid typically involves mixing nitrocellulose and camphor in the presence of solvents, such as ethanol and acetone. A common celluloid manufacturing process, known as "blocking," involves mixing the nitrocellulose, camphor, and other ingredients, followed by straining, roll milling and "hiding". A selected number of "hides" are then blocked at a desired pressure and temperature into a fused block, which is then sliced into sheets at desirable thickness after a conditioning period. Alternatively, celluloid can be manufactured by "film casting," which involves mixing nitrocellulose, camphor, and other ingredients, and subsequently casting, and drying, the mixture into film of a desired thickness.

As stated above, other than nitrocellulose and camphor, celluloid may contain a number of other ingredients, or additives, such as dyes and fillers for various applications. Common applications for celluloid, today, include guitar picks, ping-pong balls, and some writing and musical instruments.

It is known that celluloid can easily be formed into relative rigid structures of relatively complex geometries and is useful for casings for explosives, or flares, or munitions; however, the various combustible applications experience burn residue issues, as well as, other issues of mechanical strength and embrittlement, especially at low temperatures. Of these issues, burn residue issues are the most problematic; especially when, celluloid is used as the material of construction for combustible increment containers for pyrotechnic or military mortars (aka mortar increment charges or MICs), and in other artillery propulsion systems—burn residue can obstruct launch tubes of the various projectile/artillery systems. Any such obstruction, within a launch tube, can lead to misfires or hang fires, which could result in an untimely detonation of the projectile, with significant potential for injury or death to the crew.

U.S. patent application Ser. Nos. 12/977,374 and 12/483,420, disclosure foamed celluloid, a fast burning material that is almost completely flammable—such that it is essentially residue free—thereby, among other things, avoiding the above detailed problem of obstructions within launch tubes. Further, casings for explosives, or flares, or munitions, or the like manufactured of foamed celluloid do not suffer from the mechanical strength and embrittlement issues that such products manufactured of celluloid suffer from at low temperatures. However, there is a need in the art for an economically process to mass produce such foamed celluloid.

SUMMARY OF INVENTION

The present invention addresses the need for an economical method for the manufacture of foamed celluloid products—a method which involves three or four steps—depending upon whether a higher or lower density foamed celluloid product is desired and whether the lower density foamed celluloid product involves simple geometry or not. To obtain a higher density (about 0.7 to about 1.25 gm/cc) foamed celluloid products and lower density (about 0.2 gm/cc or lower, to about 0.7 gm/cc) foamed celluloid products having simple geometries, i.e. such as a solid cylinder, a truncated cone, a cylindrical cup (without any handle), or a solid cube, or the like, the invention involves 3 steps. The three steps being: (1) providing as a required starting material small, generally uniform, celluloid pieces, beads or pellets that are no smaller than 0.1 mm in smallest cross-section (preferably about 3 mm, or larger, in largest cross-section, more preferably about 2 mm in largest cross-section, and most preferably cylindrical in shape, with a diameter of about 1.4 mm, more preferably about 0.8 mm, and a length or height to diameter ratio of about 1:1); (2) presoaking the pellets, at about negative 50 to about positive 150 degrees F., preferably about 65 to 80 degrees F., in a physical blowing agent (PBA), at pressures from about 40 to about 10,000 psi, preferably about 200 to about 2,000 psi, and most preferably 500 to 1,500 psi—in a pressurized reaction vessel, for a period of from about 5 minutes to about 72 hours, preferably about 15 minutes to about 24 hours, and most preferably about 30 minutes to about 8 hours (note: with higher pressure, less hold time is required); and, (3) for the high density foamed celluloid, the now presoaked pellets are transferred to a mold and heated from about 200 to about 300 degrees F., preferably from about 215 to about 290 degrees F., with heating media, such as hot water, steam, hot air, or hot oil—preferably, either direct steam (injected into the mold cavity) or indirect steam (a jacket around the mold cavity)—the steam being at from about 15 psi, to less than about 50 psi—for a period of from about 2 to about 60 seconds, during which time the foaming takes place and the foamed celluloid can increase in size up to 3 or more times, thereby filling the mold. Alternatively, for low density, simple geometry, foamed celluloid products, step 3 is the same as for the high density foamed celluloid product; except, a smaller quantity of presoaked pellets is transferred to the mold—to allow the pellets to expand further, to obtain the desired lower density.

The inventive process for obtaining lower density (about 0.2 gm/cc, or lower, to about 0.7 gm/cc) foamed celluloid products, having any moldable geometry, involves four steps. The steps being: (1) providing as the starting material, small, generally uniform, celluloid pieces, beads or pellets starting material, as detailed in the process above; (2) presoaking the pellets, as detailed in the process above; and next, (3) pre-expanding the presoaked pellets. Wherein, the pre-expansion step can be done in the same pressurized reaction vessel as the presoaking or in another vessel. The pre-expansion step includes, heating, for a period of less than 5 minutes, the pellets with heating media, such as hot water, steam, hot air, or hot oil (either injected directly into whatever vessel is holding the pellets, to contact the pellets, or flowed through a heating jacket provided about the vessel)—to a temperature of from about 80 to about 110 degrees C., preferably from about 90 to 100 degrees C. —to provide pre-expanded pellets having a density from about 0.3 gm/cc to about 1.1 gm/cc. The now pre-expanded pellets are transferred to a mold for step (4), wherein the pre-expanded pellets heated from about 200 to about 300 degrees F., preferably from about 215 to about 290 degrees F., with heating media, such as hot water, steam, hot air, or hot oil—preferably, either direct steam (injected into the mold cavity) or indirect steam (a jacket around the mold cavity)—for a period of from about 2 to about 60 seconds—during which time the foaming takes place and the foamed celluloid can increase in size up to 3 or more times to fill the mold.

The nature of the subject invention will be more clearly understood by reference to the following detailed description and the appended claims.

DETAILED DESCRIPTION OF THE INVENTION

The inventive manufacturing process for foamed celluloid, as outlined above, involves initially providing small, generally uniform pieces, beads, or pellets of celluloid as the starting material, which are not less than 0.1 mm in smallest cross-section, preferably about 3 mm, or larger, in largest cross-section, more preferably about 2 mm in largest cross-section. The celluloid pieces, beads, or pellets, can preferably be cylindrical in shape, with a diameter of about 3.0 mm or more, preferably a diameter of about 0.8 mm, and a length to diameter ratio of about 1:1. Such pelletized celluloid starting material can preferably be manufactured by: (1) mixing, in an organic solvent, the solvent preferably being ethanol or acetone, about 50 to 85 wt. percent nitrocellulose, preferably 70 to 80 wt. percent nitrocellulose (with an about 10.8 to about 12.6 Nitrogen percent), with about 15 to 50 wt. percent, preferably 20 to 30 wt. percent, of a plasticizer, preferably camphor; where the ratio of the solvent to the nitrocellulose/plasticizer mix is about 1:2 by weight; (2) dissolving about 1% by weight of stabilizer in an organic solvent, preferably ethanol or isopropanol into the nitrocellulose/plasticizer solution; dissolving a quantity of 3 to 5% by weight chemical blowing agent (CBA), such as bi-carbonate, phenyl tetrazole, or azo compounds, to the now nitrocellulose/plasticizer/stabilizer solution. The overall mixing process may take up to 30 minutes to 1 hour, and can be done, preferably, under ambient conditions—however, the mixing can be done at elevated temperature, up to about 95 degrees Celsius (C), to help reduce the time to get the various ingredients into solution. The nitrocellulose/plasticizer/stabilizer solution is then, step (3), consolidated, wherein the nitrocellulose/plasticizer/stabilizer mixture is pressed it in a standard hydraulic block press—at about ambient to 98 degrees C., preferably ambient to about 95 degrees C., for about 10 to 30 minutes—to drive-off most of the solvent; and (4) the pressed blocks are fed through an extrusion pressed through a die, to form spaghetti like strands, which are then cut to length—using an die face cutter or by being fed into a stand alone cutter. The cut spaghetti segments can preferably be about 3 mm, or about 2 mm in diameter, as desired, and with a length to diameter ratio of about 1:1—such that the length is at least about 3 or about 2 mm long, respectively, i.e. the pellets are short cylinders—for easy handling, better packing, and easier subsequent processing, i.e. fusing into the final product during the foaming and molding steps (below). Further, the size of the pellets can be easily adjusted to the size of the finished product large pellets for larger products. And finally, the pellets are then, step (5), air dried for up to about 24 hours to allow the balance of the solvent to evaporate—such that the final density will be about 1.4 gm/cm$^3$.

As detailed above, the inventive process for obtaining higher density (about 0.7 to about 1.25 gm/cc) foamed celluloid products and lower density (about 0.2 gm/cc or lower, to about 0.7 gm/cc) foamed celluloid products having a simple geometries, i.e. such as a cylinder, truncated cone, or a cube, involves three steps. The three steps being: (1) providing as a starting material small, generally uniform, celluloid pieces, beads or pellets (not less than 0.1 mm in smallest cross-section, and preferably about 3 mm, or more, in largest cross-section, more preferably about 2 mm in largest diameter, and most preferably cylindrical in shape, with a diameter of about 1.4 mm, more preferably up to about 0.8 mm, and a length or height to diameter ratio of about 1:1); (2) presoaking the pellets at about negative 50 to about positive 150 degrees F., preferably about 65 to 80 degrees F., in a physical blowing agent (PBA), at pressures from about 40 to about 10,000 psi, preferably about 200 to about 2,000 psi, most preferably from about 500 to about 1,500 psi—in a pressurized reaction vessel, for a period of from 5 minutes to 72 hours, preferably 15 minutes to 24 hours, and most preferably 30 minutes to 8 hours (note: with higher pressure, less hold time is required); and, (3) for the high density foamed celluloid, the now presoaked pellets are transferred to a mold and heated from about 200 to about 300 degrees F., preferably from about 215 to about 290 degrees F., with heating media, such as hot water, steam, hot air, or hot oil—preferably, either direct steam (injected into the mold cavity) or indirect steam (a jacket around the mold cavity)—the steam being at from about 15 psi, to less than about 50 psi—for a period of from about 2 to about 60 seconds, during which time the foaming takes place and the foamed celluloid can increase in size up to 3 or more times, thereby filling the mold. Alternatively, for low density, simple geometry, foamed celluloid products, step 3 is the same as for the high density foamed celluloid product; except, a smaller, predetermined quantity of presoaked pellets is transferred to the mold—to allow the pellets to expand further, to obtain the desired lower density.

As detailed above, the inventive process for obtaining lower density (about 0.2 gm/cc, or lower, to about 0.7 gm/cc) foamed celluloid products having any moldable geometry, includes four steps. The four steps being: (1) providing as the starting material, small, generally uniform, celluloid pieces, beads or pellets starting material, as detailed in the process above; (2) presoaking the pellets, as in the process above; (3) pre-expanding the presoaked pellets. Wherein, the pre-expansion step can be done in the same pressurized reaction vessel as the presoaking or in another vessel. The pre-expansion step includes, heating for a period of less than 5 minutes, the pellets with heating media, such as hot water, steam, hot air, or hot oil (either injected directly into whatever vessel is holding the pellets, to contact the pellets, or flowed through a heating jacket provided about the vessel)—to a temperature of from about 80 to about 110 degrees C., preferably from about 90 to 100 degrees C. —to provide pre-expanded pellets having a density from about 0.3 gm/cc to about 1.1 gm/cc. The now pre-expanded pellets are transferred to a mold for step (4), wherein the pre-expanded pellets are heated from about 200 to about 300 degrees F., preferably from about 215 to about 290 degrees F., with heating media, such as hot water, steam, hot air, or hot oil—preferably, either direct steam (injected into the mold cavity) or indirect steam (a jacket around the mold cavity)—the steam being at from about 15 psi, to less than about 50 psi—for a period of from about 2 to about 60 seconds—during which time the foaming takes place and the foamed celluloid can increase in size up to 3 or more times to fill the mold.

Useful molding machines and molds, for use in the present invention, can be obtained from Hirsch Maschinebau Gmbh, A-9555 Glanegg, Germany; Teubert Maschinenbau Gmbh, D-78176 Blumberg, Germany; or D-97892 Kreuzwertheim, Germany.

As detailed above, preferred components in the subject invention include plasticizers, CBAs, and PBAs. Particularly preferred plasticizers include camphor, naphthalene, naphtyl acetate, phenoloxylacetic acid, naphtholoxylacetic acid, and their anhydrides and esters, naphthelketone, dinaphthylketone, and derivatives of aromatic sulpho acids; with camphor being the most particularly preferred. Particularly preferred CBAs, include, bi-carbonate; phenyl tetrazole; azo compounds (such as azodicarbonamide); and sulfonyl hydrazide; and other gas generating compounds of which more than 50% can decompose to gas at elevated temperature less than 300 degrees Fahrenheit. And, finally, particularly preferred PBAs, include, $N_2$, $CO_2$, Argon, VOC (i.e. pentane, iso-butane); CFC, HFC, and HCFC.

Also, as discussed above, preferably a stabilizer is added to the subject foamed celluloid inventive formulation. As NC tends to degrade over time the stabilizer minimizes such degradation and absorbs the products of such degradation. Preferred stabilizers include 1-methyl-3,3-diphenylurea (aka Akardite II) and ethyl centralite.

The nitrocellulose (NC) useful in the present invention has a about 10.0 to about 13.6% nitration level, most preferably about 10.8 to about 11.6%. This material is generally transported in water, or ethanol, to present it being dry—a condition under which is become very volatile. Therefore, as detailed above, to obtain the desired organic solvent mixture, it is preferred that the NC used in the subject invention is delivered in ethanol.

Other ingredients can be added to the NC mix in formulating the present invention, such as (1) a colorant, usually added as 0.01 to about 10 wt percent of the total weight of the NC and plasticizer mixture; (2) a nucleation agent—to help control the size of the gas bubbles within the foam structure of the foamed celluloid and therefore the density; (3) a polymeric material having good miscibility with respect to NC—to help form a more homogenous structure—preferred polymeric ingredients being polypropylene carbonate and polyethylene carbonate; and, finally, (4) an energetic plasticizer—to help increase the overall energetic profile of the inventive foamed celluloid. Notwithstanding these other ingredients, it may be desirable to add various functional additives or fillers to the present inventive foamed celluloid, such ingredients may include, but are not limited to, impact modifiers, conductive fillers, and reinforcement fillers.

We claim:

1. A method of manufacture of a foamed celluloid product having a low density of from about 0.2 to about 0.7 g/cc, with a simple geometric shape, the method consisting of:

a. providing small, generally uniformly shaped pieces of celluloid, not smaller than about 0.1 mm in smallest cross-section;

b. presoaking the pieces of celluloid in a pressurized reaction vessel, at a temperature of about −50 to about 150 degrees F., in an atmosphere of a physical blowing agent, at a pressure of from about 40 to about 10,000 psi, for a period of from 5 minutes to 72 hours;

c. transferring a predetermined quantity of presoaked pieces of celluloid to a mold having the desired shape of the foamed celluloid product, wherein the pieces are heated to from about 200 to about 300 degrees F., for a period of from about 2 to about 60 seconds, during which time the pieces of quantity of celluloid foam and expand and take the desired shape and density.

2. A method of manufacture of a foamed celluloid product having a low density of from about 0.2 to about 0.7 g/cc, the method consisting of:

a. providing small, generally uniformly shaped pieces of celluloid, not smaller than about 0.1 mm in smallest cross-section;

b. presoaking the pieces of celluloid in a pressurized reaction vessel, at a temperature of about −50 to about 150 degrees F., in an atmosphere of a physical blowing agent, at a pressure of from about 40 to about 10,000 psi, for a period of from 5 minutes to 72 hours;

c. heating the presoaked pieces of celluloid to a temperature of from about 80 to about 110 degrees C. to a density of from about 0.3 to about 1.1 g/cc, thereby pre-expanding the presoaked pieces;

d. transferring the pre-expanded pieces to a mold having the desired shape of the foamed celluloid product, wherein the pieces are heated to from about 200 to about 300 degrees F., for a period of from about 2 to about 60 seconds, during which time the pre-expanded pieces completely foam and expand and take the desired shape at the desired density.

3. The method of manufacture of the foamed celluloid product of claim 1, wherein the provided small, generally uniformly shaped pieces of celluloid, are about 3 mm, or more, in largest cross-section.

4. The method of manufacture of the foamed celluloid product of claim 1, wherein the physical blowing agent is selected from the group consisting of $N_2$, $CO_2$, Argon, pentane, iso-butane, CFC, HFC, and HCFC.

5. The method of manufacture of the foamed celluloid product of claim 1, wherein presoaking is at a temperature of from about 65 to 80 degrees F.

6. The method of manufacture of the foamed celluloid product of claim 1, wherein presoaking is at a pressure of from about 200 to about 2,000 psi.

7. The method of manufacture of the foamed celluloid product of claim 1, wherein presoaking is at a pressure of from about 500 to about 1,500 psi.

8. The method of manufacture of the foamed celluloid product of claim 1, wherein presoaking is for a period of from about 15 minutes to about 24 hours.

9. The method of manufacture of the foamed celluloid product of claim 1, wherein presoaking is for a period of from about 30 minutes to about 8 hours.

10. The method of manufacture of the foamed celluloid product of claim 2, wherein the provided small, generally uniformly shaped pieces of celluloid, are about 3 mm, or more, in largest cross-section.

11. The method of manufacture of the foamed celluloid product of claim 2, wherein the physical blowing agent is selected from the group consisting of $N_2$, $CO_2$, Argon, pentane, iso-butane, CFC, HFC, and HCFC.

12. The method of manufacture of the foamed celluloid product of claim 2, wherein presoaking is at a temperature of from about 65 to 80 degrees F.

13. The method of manufacture of the foamed celluloid product of claim 2, wherein presoaking is at a pressure of from about 200 to about 2,000 psi.

14. The method of manufacture of the foamed celluloid product of claim 2, wherein presoaking is at a pressure of from about 500 to about 1,500 psi.

15. The method of manufacture of the foamed celluloid product of claim 2, wherein presoaking is for a period of from about 15 minutes to about 24 hours.

16. The method of manufacture of the foamed celluloid product of claim 2, wherein presoaking is for a period of from about 30 minutes to about 8 hours.

* * * * *